US005357661A

United States Patent [19]

Eriksen et al.

[11] Patent Number: 5,357,661

[45] Date of Patent: Oct. 25, 1994

[54] STRETCHING MACHINE

[75] Inventors: Gunnar Eriksen, Borgen; Sissel W. Olsen, Tranby, both of Norway

[73] Assignee: Kvaerner Eureka a.s., Tranby, Norway

[21] Appl. No.: 200,881

[22] Filed: Feb. 22, 1994

Related U.S. Application Data

[63] Continuation of Ser. No. 942,115, Sep. 2, 1992, abandoned.

[30] Foreign Application Priority Data

Jul. 23, 1992 [NO] Norway ..... 922928

[51] Int. Cl.[5] ..... D06C 3/00; D06C 7/00

[52] U.S. Cl. ..... 26/51; 26/81; 26/106; 162/274

[58] Field of Search ..... 26/57, 99, 18.6, 104, 26/106, 18.5, 80, 81, 71; 162/206, 207, 290, 360.3, 375, 376, 377, 378; 34/111, 116, 123

[56] References Cited

U.S. PATENT DOCUMENTS

| | | | |
|---|---|---|---|
| 1,861,422 | 5/1932 | Cluett | 26/18.6 |
| 2,526,318 | 10/1950 | Battin | 26/106 |
| 3,866,277 | 2/1975 | Hojyo | 162/206 |
| 3,940,833 | 3/1976 | Troope et al. | 26/18.6 |
| 4,495,714 | 1/1985 | Eriksen | 162/274 |
| 4,504,359 | 3/1985 | Eriksen | 162/274 |

*Primary Examiner*—Clifford D. Crowder
*Assistant Examiner*—Amy B. Vanatta
*Attorney, Agent, or Firm*—Young & Thompson

[57] ABSTRACT

A stretching machine for treating removable belts supported on rollers, such as felts and wires in papermaking machines, comprises two rollers, over which the belt is trained in a loop. A heated belt contact structure has a contact surface adapted to contact the belt on the outside of the loop and between the rollers. A press roller is adapted to make press contact with the belt on the inside of the loop opposite the belt contact structure. The belt contact structure comprises a glide contact surface and a roller, the press roller acting against this latter roller.

6 Claims, 1 Drawing Sheet

STRETCHING MACHINE

This application is a continuation of application Ser. No. 07/942,115, filed, Sep. 2, 1992, now abandoned.

The invention pertains to an improvement in a stretching machine for treating removable belts supported on rollers, such as felts and wires in paper-making machines. Stretching machines of this type have two rollers over which the belt is trained, the rollers being movable toward and away from each other on rails or the like. At least, one of the rollers is adapted to be heated, usually by recirculating oil and to a temperature of 150°–250° C.

When a felt is "driven" against a heated roller, the objective, among others, is to obtain a smooth surface on the so-called paper side of the felt, i.e. the felt surface which is on the outside when the felt is running in the paper-making machine. Thus, today the felts are reversed (turned inside out) before they are heated in the stretching machine so that thereby the final outside shall get contact with the heated roller. After treatment the felts are reversed again so that the paper side will be the outer side. Felt reversing is a relatively demanding operation.

An object of the invention is to propose means which allow the treatment of a felt loop the paper side of which is facing outwards, thereby avoiding the felt reversing.

Thus, according to the invention it is proposed to provide a stretching machine with means for contacting and smoothing of the outer (paper) side of a felt.

The invention will now be explained with reference to the drawing figures, which show various embodiments of the inventive concept.

Figure 1:
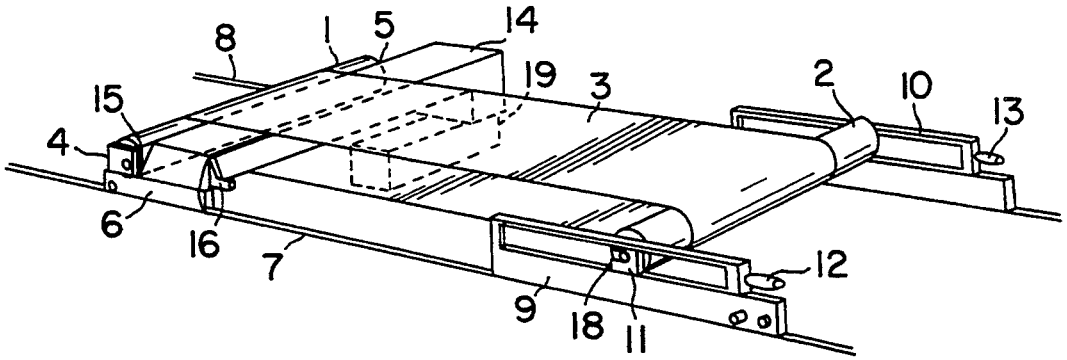
FIG. 1 (PRIOR ART)
FIG. 1 is a perspective view of a known stretching machine.

FIG. 1 shows only the essential components in a known stretching machine. The two rollers are designated 1 and 2. A belt 3 is trained around the rollers 1 and 2. The roller 1 is supported at each end in bearings 4 and 5. The roller 1 can be made to rotate in the bearingd 4 and 5 by means of a drive motor (not shown). The bearing 4 is mounted on a carriage 6 which can be moved along the floor rail 7. The roller 2 is rotatably supported at each end in bearings 11 (only one is illustrated). The bearings 11 are adjustably mounted in the carriages 9, 10, by means of the illustrated drive motors 13, which drive screw spindles (not shown) that cooperate with nuts in the bearings 11. The two carriages 9 and 10 can be moved on floor rails 7 and 8.

A U-shaped cantilever beam 14 is built into the apparatus, one of its legs being above the floor and one leg beneath the floor (passing through the floor at 19), extending parallel with the roller 1, between the two roller supports for the belt 3. The free end of the cantilever beam 14 extends out to the carriage 6. On the free end, the cantilever beam 14 is provided with two projecting support arms 15 and 16. The support arm 15 cooperates with the forward shaft journal on the roller 1 at the bearings 4, while the support arm 16 serves the same purpose for the forward shaft journal on the roller 2. When the roller 2 is driven in toward the cantilever beam by means of the carriages 9 and 10, the cantilever beam is raised by means of lifting members (not shown), whereby the support arms 15 and 16 are brought into engagement with the respective shaft journal on the rollers 1 and 2 and assume support of the rollers. Prior to this, of course, the shaft journals have been released from their respective bearings 4 and 11. The bearings 11 can be opened (at 18) and after the cantilever beam 14 has assumed the support function at the front of the roller , the carriage 9 can be driven away on the rails 7. Similarly, the carriage 6 with the bearings 4 can be driven away on the fall 7, such that one has free access to the rollers from the side and can thus easily affix or remove the belt.

A stretching machine of this general type can comprise different pieces of equipment for the treatment of the belt. For example, it can be provided with an air-drying assembly, which then can advantageously be built into the cantilever beam. The roller 1 can also be adapted to be treated.

Figure 2:
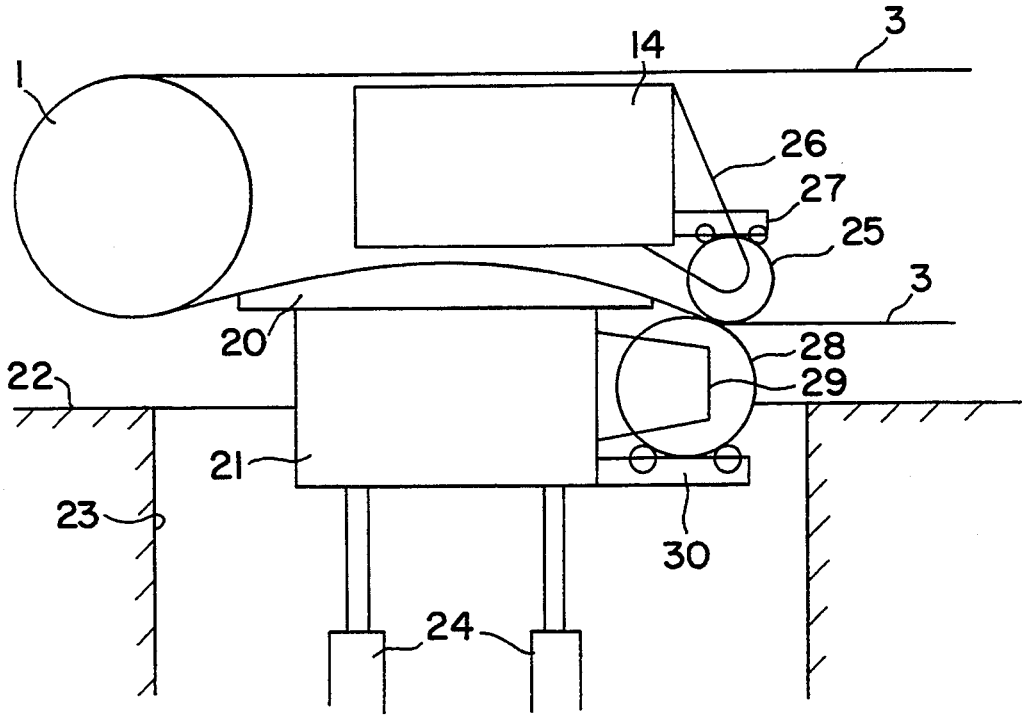
FIG. 2 shows a schematic left hand view of a stretching machine according to the invention.

The apparatus of the invention is shown schematically in FIG. 2, which is a view of the region of the roller 1 in the stretching machine of FIG. 1.

A heatable glide shoe 20 is mounted below the belt loop, on a support means 21 which has been sunk into the floor in a pit 23. The support means 21 and thereby the glide shoe are retractable into the pit 29 by means of hydraulic cylinders 24.

A press roller 25 extending in the belt loop is rotatably supported on the cantilever beam 14 in bearing brackets 26. Sets of support rollers 27 are provided along the length of the press roller 25. The press roller 25 can be made to rotate by a drive motor (not shown).

A smoothing roller 28 representing a roller contact surface means is provided beside the glide shoe 20 and is rotatably supported in bearing brackets 29. Sets of supporting rollers 30 are provided along the roller 28.

In the disclosed embodiment the press roller 25 is pressing against the smoothing roller 28. It may, however, within the framework of the invention be arranged to press against the glide shoe 20. Contact between two rollers means, of course, lesser friction resistance for the belt 3 in the apparatus.

Various modification of the invention are feasible.

The glide shoe support may be movably mounted for movement in a direction along the belt, for instance on a cart. The glide shoe may also be arranged to act on the top side of the belt loop, the glide shoe support then for example being roof mounted. It is of course, also within the frame of the invention to have a plurality of press rollers acting against the belt contact means.

We claim:

1. In a stretching machine for treating removable belts supported on rollers, the stretching machine comprises two rollers over which the belt is trained in a loop and means to move the rollers towards and away from each other to slacken and stretch the belt, the improvement comprising a belt contact means having a contact surface adapted to contact the belt on the outside of the loop and between the rollers, said contact surface being a stationary convex surface that deflects the belt inwardly by imparting to the belt a single outwardly concave outer surface over all that portion of the belt in contact with said contact surface, means to heat the belt contact means, a press roller adapted to make press contact with the belt on the inside of the loop opposite said belt contact means, and power means to rotate said press roller.

2. A stretching machine according to claim 1, wherein the belt contact means comprises a glide contact surface means and a further roller, said press roller acting against said further roller.

3. A stretching machine according to claim 1, further comprising means supporting said belt contact means for movement to and from the belt.

4. A stretching machine according to claim 2, further comprising means supporting the belt contact means for movement to and from the belt.

5. A stretching machine according to claim 1, wherein said press roller is supported on a cantilever beam in said belt loop.

6. A strecthing machine according to claim 2, wherein said press roller is supported on a cantilever beam in said belt loop.

* * * * *